US007319296B2

(12) United States Patent
Meng et al.

(10) Patent No.: US 7,319,296 B2
(45) Date of Patent: Jan. 15, 2008

(54) DEVICE FOR DRIVING LAMPS

(75) Inventors: Tien-Hsiang Meng, Shenzhen (CN); Chi-Hsiung Lee, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,767

(22) Filed: Sep. 22, 2006

(65) Prior Publication Data

US 2007/0217183 A1 Sep. 20, 2007

(30) Foreign Application Priority Data

Feb. 28, 2006 (CN) ..... 200610034072

(51) Int. Cl.
*H05B 41/16* (2006.01)

(52) U.S. Cl. ..... 315/282; 315/274; 315/291; 315/307; 315/312

(58) Field of Classification Search ..... 315/272–289, 315/247, 246, 209 R, 291, 307, 352, 354
See application file for complete search history.

(56) References Cited

U.S. PATENT DOCUMENTS 6,172,467 B1 1/2001 Vollkommer et al.
7,173,379 B2 * 2/2007 Ball ..... 315/213
7,250,731 B2 * 7/2007 Jin ..... 315/282

* cited by examiner

*Primary Examiner*—Tuyet Vo
(74) *Attorney, Agent, or Firm*—Wei Te Chung

(57) ABSTRACT

A driving device for driving a plurality of lamps each including a first terminal and a second terminal, includes a power stage circuit (202), a transformer circuit (204) electrically connectable to the power stage circuit, and a current balancing circuit (206) to balance current of the lamps. The current balancing circuit includes a plurality of current balancing components each comprising two inputs and two outputs. The number of the current balancing components is defined as n, where n is an integer from 2 to n. The inputs of the first current balancing component are electrically connected to a terminal of the transformer circuit. The inputs of the $n^{th}$ current balancing component are electrically connected to the outputs of the $(n-1)^{th}$ current balancing component. The outputs of each current balancing component are respectively electrically connected to the first terminals of two of the lamps.

18 Claims, 5 Drawing Sheets

DEVICE FOR DRIVING LAMPS

FIELD OF THE INVENTION

The invention relates to electronic driving devices, and particularly to a device for driving lamps.

DESCRIPTION OF RELATED ART

Conventionally, discharge lamps have been used as light sources for liquid crystal display (LCD) panels, and must be driven by high voltages. In order to ensure the discharge lamps operate normally, a driving device is used for balancing current to the lamps.

Referring FIG. 5, a conventional driving device is shown. The driving device includes a direct current (DC) power source 10, a power stage circuit 11, a transformer circuit 12, and three current balancing components 13, 14, 15 to balance current of four lamps 16, 17, 18, 19. Each of the lamps 16, 17, 18, 19 includes a first terminal and a second terminal.

The direct current power source 10 provides a DC signal to the power stage circuit 11. The power stage circuit 11 converts the DC signal to an alternating current (AC) signal, and transmits the AC signal to the transformer circuit 12. The transformer circuit 12 converts the AC signal to an appropriate sine wave signal.

Each of the current balancing components includes two inputs and two outputs. The inputs of the current balancing component 13 are electrically connected to a high voltage terminal of a secondary terminal of the transformer circuit 12, and the outputs of the current balancing component 13 are respectively electrically connected to one input of the current balancing component 14 and one input of the current balancing component 15. Another input of the current balancing component 14 is electrically connected to the high voltage terminal of the secondary terminal of the transformer circuit 12, and the outputs of the transformer circuit 14 are respectively electrically connected to the first terminals of the lamps 16, 17. Another input of the current balancing component 15 is electrically connected to the high voltage terminal of the secondary winding of the transformer circuit 12, and the outputs of the transformer circuit 15 are respectively electrically connected to the first terminals of the lamps 18, 19. The second terminal of the lamps 16, 17, 18, 19 and a low voltage terminal of the secondary winding are electrically connected to ground. That is, the three current balancing components 13, 14, 16 are used to balance the currents of the four lamps 16, 17, 18, 19. However, the need for three current balancing components for just four lamps is expensive.

Therefore, a heretofore unaddressed need exists in the industry to overcome the aforementioned deficiencies and inadequacies.

SUMMARY OF THE INVENTION

An exemplary embodiment of the invention provides a driving device for driving a plurality of lamps each including a first terminal and a second terminal. The driving device includes a power stage circuit for converting a direct current (DC) signal to a first alternating current (AC) signal, a transformer circuit electrically connectable to the power stage circuit, and a current balancing circuit to balance current of the lamps. The current balancing circuit is used for converting the first AC signal to a second AC signal. The current balancing circuit includes a plurality of current balancing components each comprising two inputs and two outputs. The number of the current balancing components is defined as n, where n is an integer from 2 to n. The inputs of a first current balancing component are electrically connected to a terminal of the transformer circuit. The inputs of the $n^{th}$ current balancing component are electrically connected to the outputs of the $(n-1)^{th}$ current balancing component. The outputs of each current balancing component are respectively electrically connected to the first terminals of two of the lamps.

Other advantages and novel features will become more apparent from the following detailed description of preferred embodiments when taken in conjunction with the accompanying drawings, in which:

DETAILED DESCRIPTION OF THE INVENTION

Figure 1:
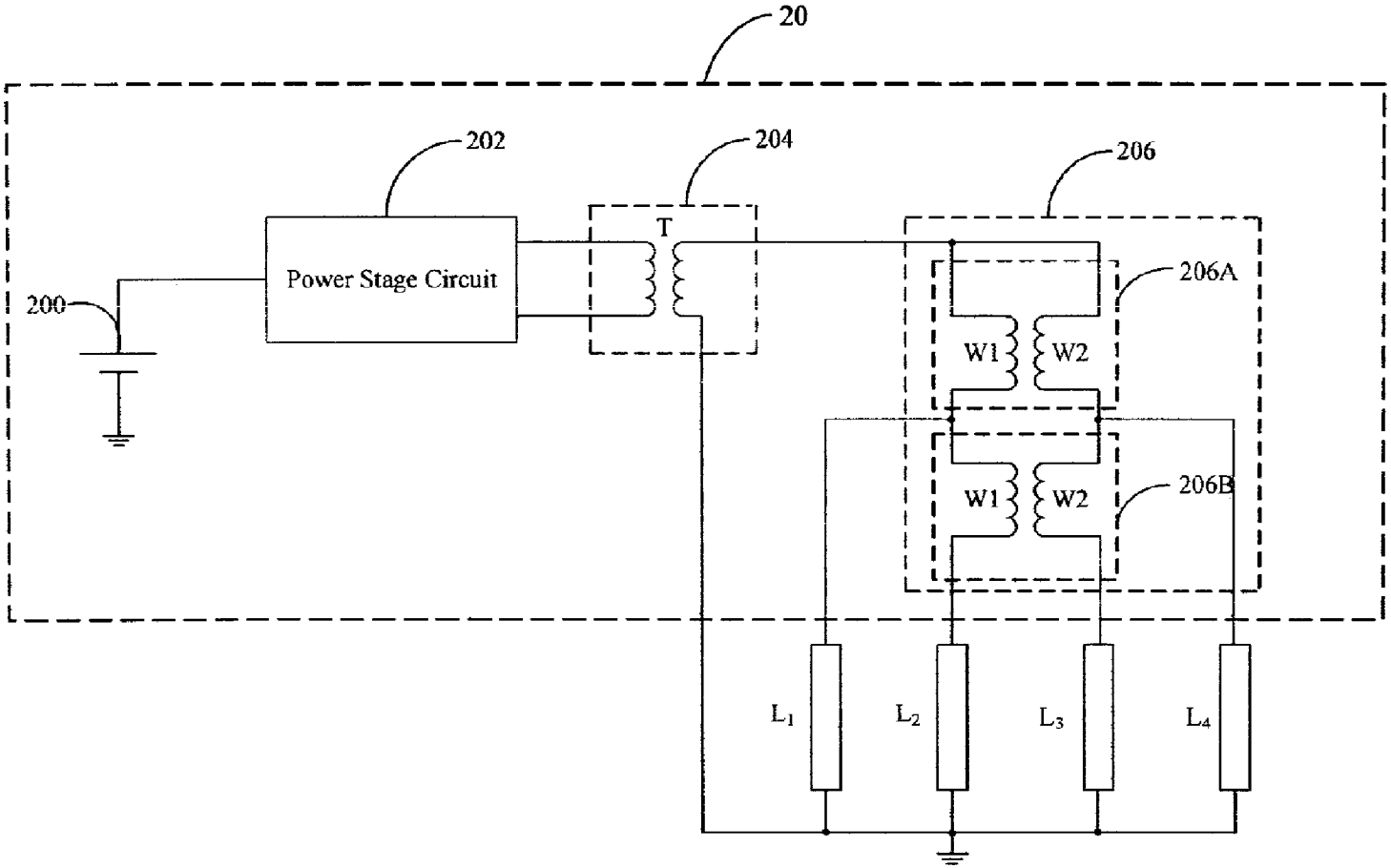
FIG. 1 is a block diagram of a driving device of a first exemplary embodiment of the present invention.

FIG. 1 is a block diagram of a driving device 20 for driving a plurality of lamps of a first exemplary embodiment of the present invention. The driving device 20 includes a direct current power source 200, a power stage circuit 202, a transformer circuit 204, and a current balancing circuit 206. In the exemplary embodiment, the lamps are labeled as $L_1$, $L_2$, $L_3$, and $L_4$. Each of the lamps includes a first terminal and a second terminal.

The direct current power source 200 provides a direct current (DC) signal to the power stage circuit 202. The power stage circuit 202 converts the DC signal to a first alternating current (AC) signal, and transmits the first AC signal to the transformer circuit 204. In the exemplary embodiment, the first AC signal is a square wave signal.

The transformer circuit 204 converts the first AC signal from the power stage circuit 202 to a second AC signal. A voltage level of the second AC signal is greater than that of the first AC signal. In the exemplary embodiment, the transformer circuit 204 is a transformer T. The transformer circuit 204 includes a primary winding electrically connectable to the power stage circuit 202, and a secondary winding. The second AC signal is a sine wave signal.

The current balancing circuit 206 includes a first current balancing component 206A, and a second current balancing component 206B. The first current balancing component 206A includes two first inputs and two first outputs. The second current balancing component 206B includes two second inputs and two second outputs. The first inputs of the first current balancing component 206A are electrically connected to a high voltage terminal of the secondary winding of the transformer circuit 204. The first outputs of the first current balancing component 206A are electrically connected to the first terminals of $L_1$ and $L_4$ respectively, to balance the current of $L_1$ and $L_4$. The second inputs of the second current circuit component 206B are electrically connected to the first outputs of the first current circuit component 206A, respectively. The second outputs of the current circuit component 206B are electrically connected to the first terminals of $L_2$ and $L_3$ respectively, to balance the currents of $L_2$ and $L_3$. In the exemplary embodiment, either the first current balancing component 206A or the second current balancing component 206B is a common-mode choke, and includes a first winding $W_1$ and a second winding $W_2$. The first winding $W_1$ and the second winding $W_2$ have a same number of turns. A low voltage terminal of the secondary winding and the second terminals of $L_1$, $L_2$, $L_3$, and $L_4$ are electrically connected to ground. In this way, the first and second current circuit component 206A, 206B balance the currents of $L_1$, $L_2$, $L_3$, and $L_4$.

Figure 2:
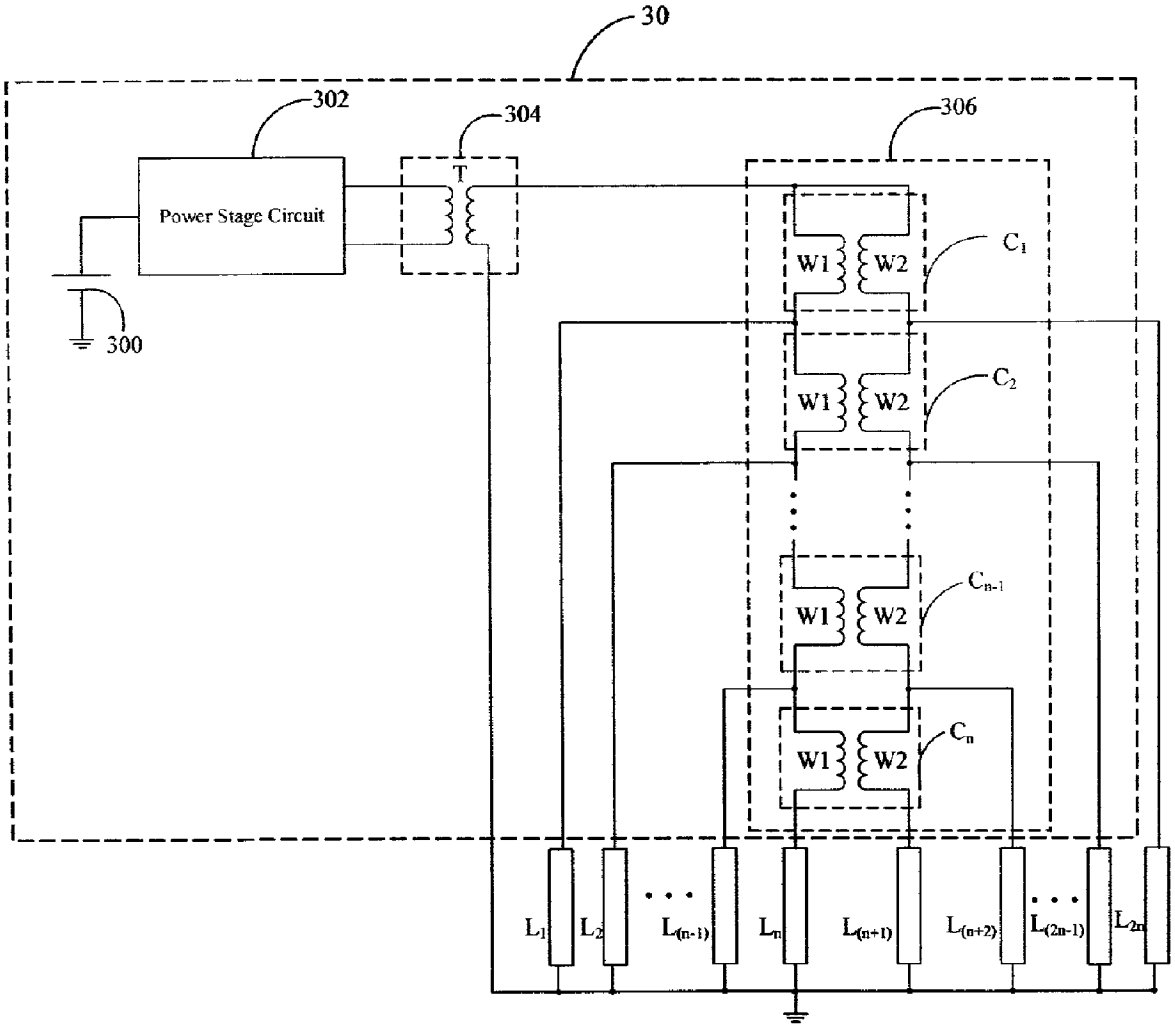
FIG. 2 is a block diagram of a driving device of a second exemplary embodiment of the present invention.

FIG. 2 is a block diagram of a driving device 30 for driving a plurality of lamps of a second exemplary embodiment of the present invention. The driving device 30 includes a direct current power source 300, a power stage circuit 302, a transformer circuit 304, and a current balancing circuit 306. In the exemplary embodiment, the lamps are consecutively labeled as $L_1$, $L_2$, . . . , $L_{2n}$ (n=2, 3, 4, . . . , n). Each of the lamps includes a first terminal and a second terminal.

The direct current power source 300, the power stage circuit 302, and the transformer circuit 304 of the driving device 30 are substantially the same as the direct current power source 200, the power stage circuit 202, and the transformer circuit 204 of the driving device 20 of FIG. 1. The current balancing circuit 306 includes a plurality of current balancing components to balance the currents of the lamps. In the embodiment, the current balancing components are consecutively labeled as $C_1$, $C_2$, . . . , $C_n$ (n=2, 3, 4, . . . , n).

The current balancing component $C_1$ includes two first inputs and two first outputs, the current balancing component $C_2$ includes two second inputs and two second outputs, and so on through to the current balancing component $C_n$ which includes two nth inputs and two nth outputs. The first inputs of the current balancing component $C_1$ are electrically connected to a high voltage terminal of a secondary winding of the transformer circuit 304, and the first outputs are respectively electrically connected to the first terminals of $L_1$ and $L_{2n}$. The second inputs of the current balancing component $C_2$ are respectively electrically connected to the first outputs of the current balancing component $C_1$. The second outputs of the current balancing component $C_2$ are respectively electrically connected to the second terminals of $L_2$ and $L_{2n-1}$. And so on through to the nth inputs of the current balancing component $C_n$ which are respectively electrically connected to the $(n-1)^{th}$ outputs of the current balancing component $C_{n-1}$. The nth outputs of the current balancing component $C_n$ are respectively electrically connected to the second terminals of $L_n$ and $L_{(n+1)}$. A low voltage terminal of the secondary winding of the transformer circuit 304 and the second terminals of the lamps are electrically connected to ground. In this way, the current balancing component $C_1$ balances the currents of $L_1$ and $L_{2n}$. The current balancing component $C_2$ balances the currents of $L_2$ and $L_{2n-1}$. The current balancing component $C_n$ balances the currents of $L_n$ and $L_{(n+1)}$. That is, the n current balancing components balance the currents of the 2n lamps.

Figure 3:
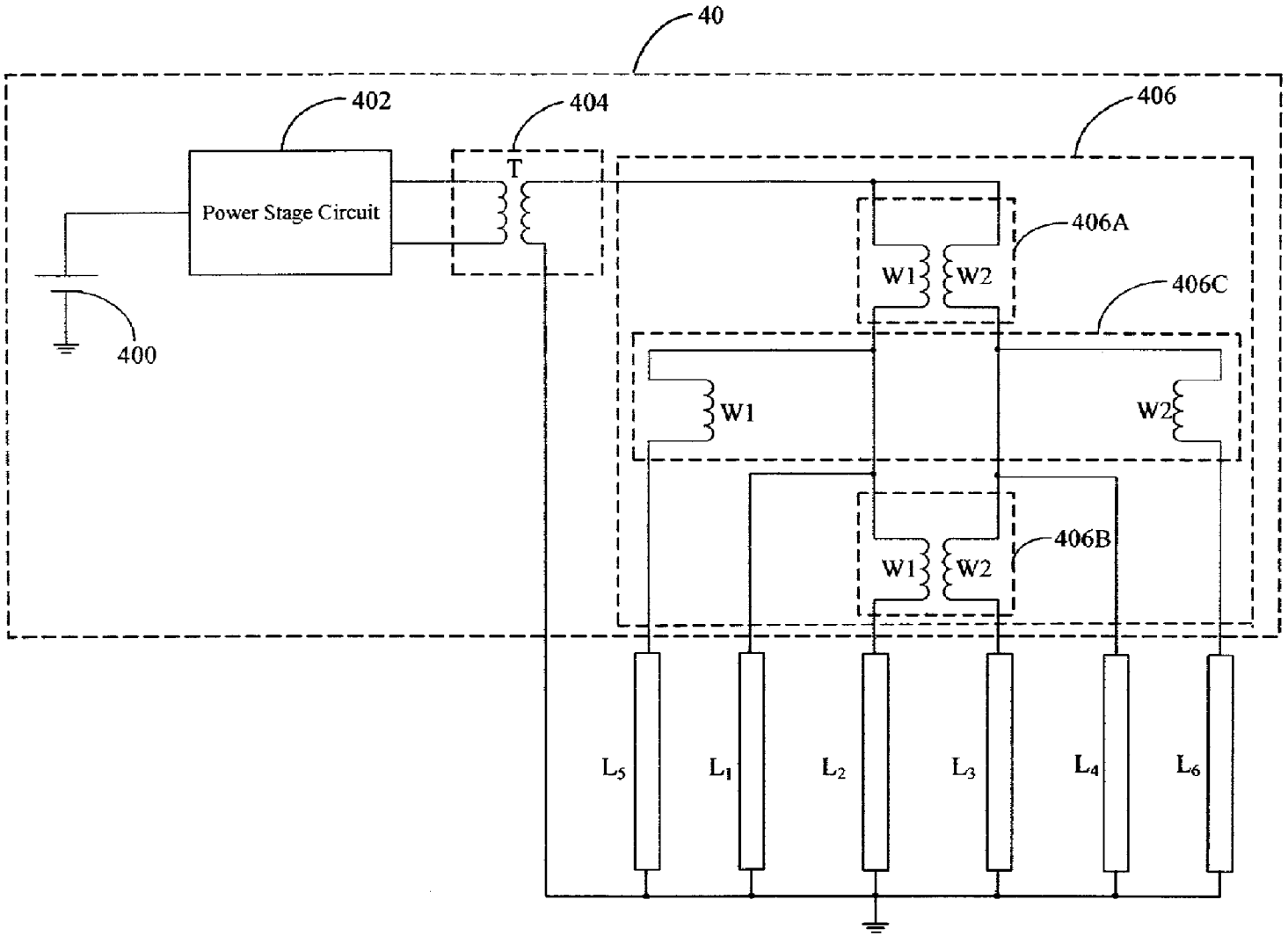
FIG. 3 is a block diagram of a driving device of a third exemplary embodiment of the present invention.

FIG. 3 is a block diagram of a driving device 40 for driving six lamps of a third exemplary embodiment of the present invention. The driving device 40 includes a direct current power source 400, a power stage circuit 402, a transformer circuit 404, and a current balancing circuit 406. In the exemplary embodiment, the lamps are labeled as $L_1$, $L_2$, $L_3$, $L_4$, $L_5$, and $L_6$. Each of the lamps includes a first terminal and a second terminal.

The direct current power source 400, the power stage circuit 402, and the transformer circuit 404 of the deriving device 40 are substantially the same as the direct current power source 200, the power stage circuit 202, and the transformer circuit 204 of the driving device 20 of FIG. 1. The current balancing circuit 406 includes three current balancing components labeled as 406A, 406B, and 406C. Connections between the current balancing component 406A and $L_1$ and $L_4$, and between the current balancing component 406B and $L_2$ and $L_3$ are the same as that of FIG. 1. Two inputs of the current balancing component 406C are electrically connected to the outputs of the current balancing component 406A, two outputs of the current balancing component 406C are electrically connected to the first terminals of $L_5$, and $L_6$. A low voltage terminal of the secondary winding of the transformer circuit 404 and the second terminals of the lamps are electrically connected to ground. In this way, the three current balancing components 406A, 406B, 406C balance the currents of the six lamps $L_1$, $L_2$, $L_3$, $L_4$, $L_5$, $L_6$.

Figure 4:
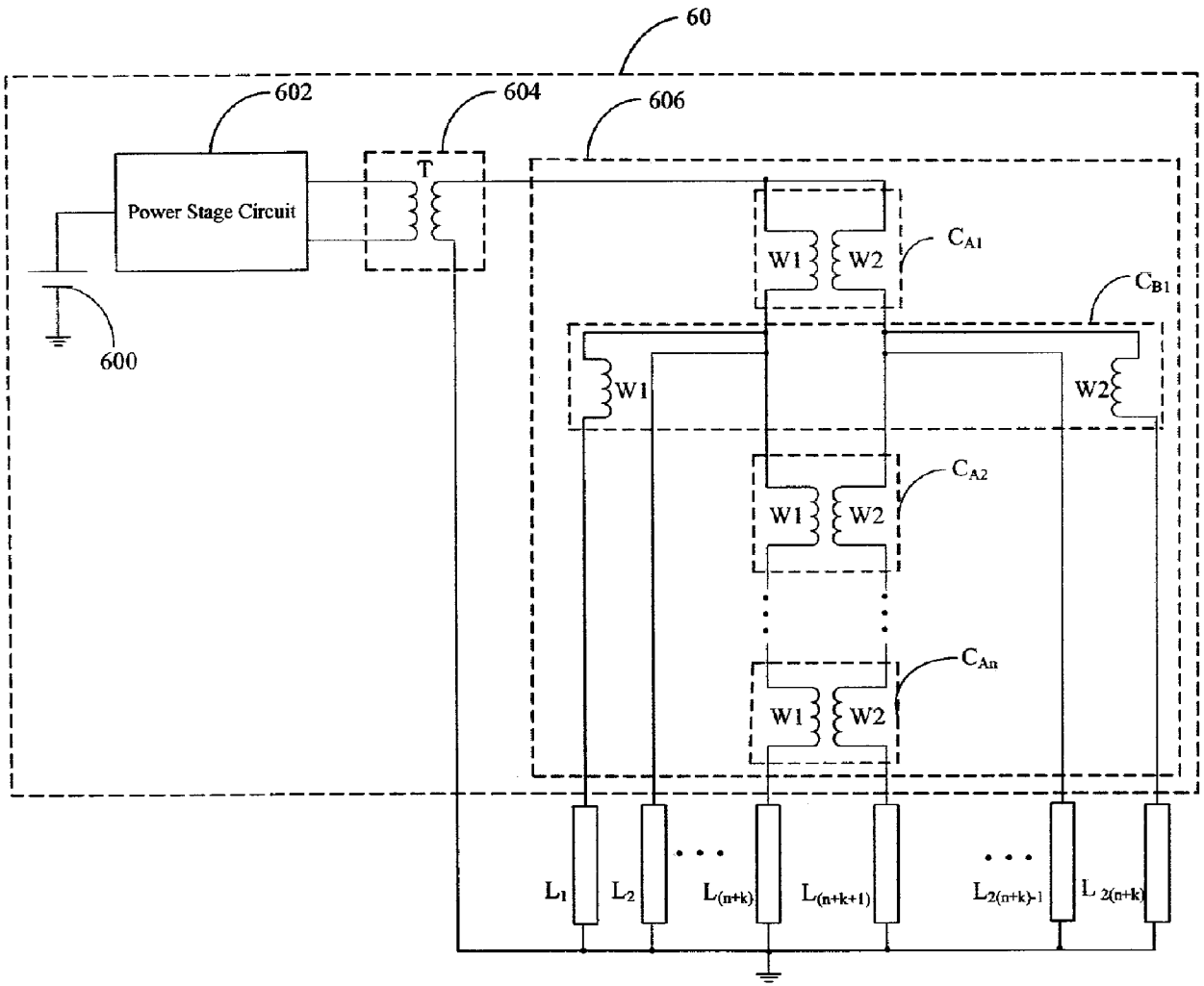
FIG. 4 is a block diagram of a driving device of a fourth exemplary embodiment of the present invention.
Figure 5:
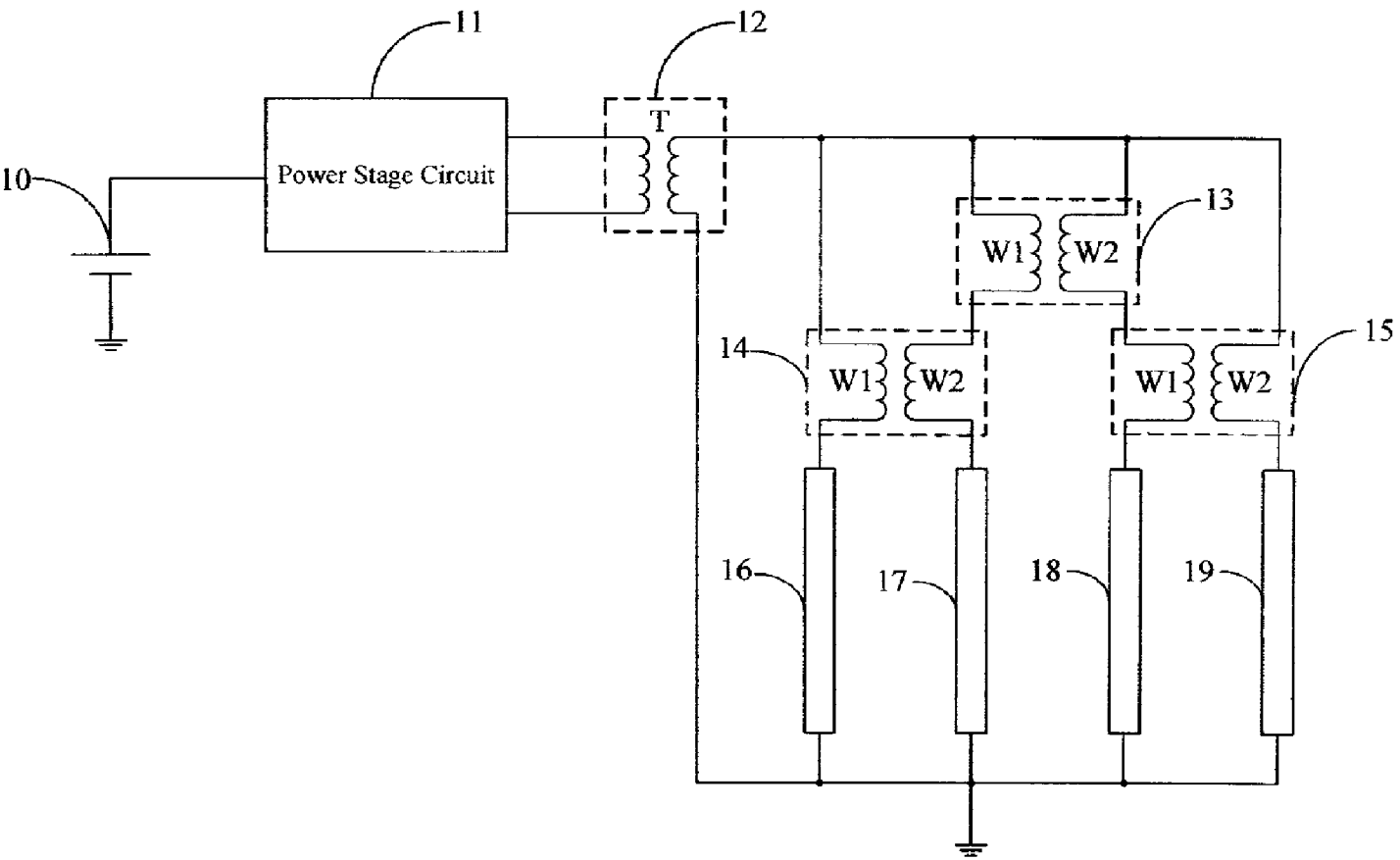
FIG. 5 (RELATED ART)
FIG. 5 is a block diagram of a conventional driving device.

FIG. 4 is a block diagram of a driving device 60 for driving a plurality of lamps of a fourth exemplary embodiment of the present invention. The driving device 60 includes a direct current power source 600, a power stage circuit 602, a transformer circuit 604, and a current balancing circuit 606. In the exemplary embodiment, the lamps are consecutively labeled as $L_1$, $L_2$, . . . , $L_{2(n+k)}$(n=2, 3, 4, . . . , n, k=1, 2, 3, . . . , k). Each of the lamps includes a first terminal and a second terminal.

The direct current power source 600, the power stage circuit 602, and the transformer circuit 604 of the deriving device 50 are substantially the same as the direct current power source 400, the power stage circuit 402, and the transformer circuit 404 of the driving device 40 of FIG. 3. The current balancing circuit 606 includes a plurality of first current balancing components and a plurality of second current balancing components to balance the currents of the lamps. In the embodiment, the first current balancing components are consecutively labeled as $C_{A1}$, $C_{A2}$, . . . , $C_{An}$ (n=2, 3, 4, . . . , n). The second current balancing components are consecutively labeled as $C_{B1}$, $C_{B2}$, . . . , $C_{Bk}$ (k=1, 3, 4, . . . , k).

The first current balancing component $C_{A1}$ includes two first inputs and two first outputs, the first current balancing component $C_{A2}$ includes two second inputs and two second outputs, the second current balancing component $C_{B1}$ includes two $(n+1)^{th}$ inputs and two $(n+1)^{th}$ outputs, and so on through to the second current balancing component $C_{Bk}$ which includes two $(n+k)^{th}$ inputs and two $(n+k)^{th}$ outputs. The first inputs of the first current balancing component $C_{A1}$ are electrically connected to a high voltage terminal of a secondary winding of the transformer circuit 304, and the first outputs are respectively electrically connected to the first terminals of $L_2$ and $L_{2(n+K)-1}$. The $(n+1)^{th}$ inputs of the second current balancing component $C_{B1}$ are electrically connected to the first outputs of the first current balancing component $C_{A1}$, and the $(n+1)^{th}$ outputs of the second current balancing component $C_{B1}$ are electrically connected to $L_1$ and $L_{2(n+k)}$. And so on through to the $n^{th}$ inputs of the first current balancing component $C_{An}$ which respectively electrically connectable to the $(n-1)^{th}$ outputs of the first current balancing component $C_{A(n-1)}$. The $n^{th}$ outputs of the first current balancing component $C_{An}$ are respectively electrically connected to the second terminals of $L_{(n+k)}$ and $L_{(n+k+1)}$. A low voltage terminal of the secondary winding of the transformer circuit 604 and the second terminals of the lamps are electrically connected to ground. In this way, the first current balancing component $C_1$ balances the currents of $L_1$ and $L_{(2n+k)-1}$. The second current balancing component $C_{B1}$ balances the currents of $L_1$ and $L_{2(n+k)}$. The first current balancing component $C_n$ balances the currents of $L_{n+k}$ and $L_{(n+K+1)}$. That is, the (n+k) current balancing components balance the currents of the 2(n+k) lamps.

In an alternative embodiment, the inputs of one of the second current balancing components can be electrically connected to the outputs of one of the first current balancing components.

Because only one current balancing component is needed for each two driving lamps with the present invention, production costs are greatly reduced.

While embodiments of the present invention have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A driving device for driving a plurality of lamps each comprising a first terminal and a second terminal, comprising:

a power stage circuit for converting a direct current (DC) signal to a first alternating current (AC) signal;

a transformer circuit electrically connectable to the power stage circuit, for converting the first AC signal to a second AC signal; and a current balancing circuit to balance currents of the lamps, the current balancing circuit comprising a plurality of current balancing components each comprising two inputs and two outputs, herein the number of the current balancing components is defined as n, where n is an integer from 2 to n;

wherein the inputs of a first current balancing component are electrically connected to a terminal of the transformer circuit, the inputs of the $n^{th}$ current balancing component are electrically connected to the outputs of the $(n-1)^{th}$ current balancing component, and the outputs of each current balancing component are respectively electrically connected to the first terminals of two of the lamps.

2. The driving device as claimed in claim 1, further comprising a direct current power source for providing a DC signal to the power stage circuit.

3. The driving device as claimed in claim 1, wherein the first AC signal is a square wave signal.

4. The driving device as claimed in claim 1, wherein the second AC signal is a sine wave signal.

5. The driving device as claimed in claim 1, wherein the transformer circuit comprises a primary winding electrically connectable to the power stage circuit, and a secondary winding.

6. The driving device as claimed in claim 5, wherein a high voltage terminal of the secondary winding is electrically connected to the inputs of the first current balancing component, a low voltage terminal of the secondary winding together with the second terminals of the lamps are electrically connected to ground.

7. The driving device as claimed in claim 1, wherein the current balancing circuit further comprises at least one current balancing component comprising two inputs electrically connectable to the outputs of one of said current balancing components and two outputs electrically connectable to the first terminals of one of the lamps.

8. The driving device as claimed in claim 7, wherein each of the current balancing components is a common-mode choke.

9. The driving device as claimed in claim 8, wherein the common-mode choke comprises a first winding and a second winding having a same number of turns.

10. An assembly comprising:

a plurality of lamps, each of the lamps comprising a first terminal and a second terminal;

a transformer circuit comprising a primary winding and a secondary winding; and a current balancing circuit to balance currents of the lamps, the current balancing circuit comprising a plurality of first current balancing components each comprising two inputs and two outputs, herein the number of the first current balancing components is defined as n, where n is an integer from 2 to n;

wherein the inputs of a first one of the first current balancing components are electrically connected to the secondary winding of the transformer circuit, the inputs of the $n^{th}$ one of the first current balancing components are electrically connected to the outputs of the $(n-1)^{th}$ one of the first current balancing components, and the outputs of each of the first current balancing components are electrically connected to the first terminals of two of the lamps.

11. The assembly as claimed in claim 10, further comprising a power stage circuit electrically connectable to the transformer circuit, and a direct current power source electrically connectable to the power stage circuit.

12. The assembly as claimed in claim 10, wherein a voltage level of the secondary winding is greater than that of the primary winding.

13. The assembly as claimed in claim 10, wherein the secondary winding comprises a high voltage terminal electrically connectable to the inputs of the first one of the first current balancing components, and a low voltage terminal which together with the second terminals of the lamps are electrically connected to ground.

14. The assembly as claimed in claim 10, wherein the current balancing circuit further comprises at least one second current balancing component comprising two inputs electrically connectable to the outputs of one of the first current balancing components and two outputs electrically connectable to the first terminals of one of the lamps.

15. The assembly as claimed in claim 14, wherein either one of the first current balancing components or the at least one second current balancing component is a common-mode choke.

16. The assembly as claimed in claim 15, wherein the common-mode choke comprises a first winding and a second winding having a same number of turns.

17. A circuit assembly comprising:

a plurality of lamps to be powered for illumination thereof;

a power stage circuit for providing power to said plurality of lamps;

a transformer circuit electrically connectable with said power stage circuit for converting said power;

a current balancing circuit electrically connectable between said transformer circuit and said plurality of lamps to balance electrical currents of said converted power flowing through said plurality of lamps, said current balancing circuit comprising at least two first current balancing components and each of said at least two first current balancing components comprising two inputs and two outputs, at least two of said at least two first current balancing components serially electrically connectable with each other by directly electrically connecting said two outputs of one of said at least two first current balancing components with said two inputs of a neighboring one of said at least two first current balancing components respectively, two of said plurality of lamps retrieving said converted power from said at least two first current balancing components by directly electrically connecting with said two outputs of a closer one of said at least two first current balancing components respectively, and the rest of said plurality of lamps retrieving said converted power from said at least two first current balancing components by electrically connecting with an electrical connection of said neighboring ones of said at least two first current balancing components.

18. The circuit assembly as claimed in claim 17, further comprising at least one second current balancing component electrically connecting with said electrical connection of said neighboring one of said at least two first current balancing components in order to provide said converted power to two of said plurality of lamps via two outputs of each of said at least one second current balancing component respectively.

* * * * *